US006238030B1

(12) United States Patent
Matselboba

(10) Patent No.: US 6,238,030 B1
(45) Date of Patent: May 29, 2001

(54) HOLLOW-DOOR CLOSET

(76) Inventor: Lottie D. Matselboba, 12439 Floresta Ct., San Diego, CA (US) 92128

( * ) Notice: Subject to any disclaimer, the term of this patent is extended or adjusted under 35 U.S.C. 154(b) by 0 days.

(21) Appl. No.: 09/611,255

(22) Filed: Jul. 6, 2000

(51) Int. Cl.[7] ..... E06B 1/00

(52) U.S. Cl. ..... 312/321.5; 312/292; 312/242; 49/169

(58) Field of Search ..... 312/321.5, 291, 312/292, 204, 138.1, 242, 245, 248, 402; 49/163, 166, 168, 169

(56) References Cited

U.S. PATENT DOCUMENTS

| | | | | |
|---|---|---|---|---|
| D. 424,119 | | 5/2000 | Ashley et al. | D20/37 |
| 1,509,285 | * | 9/1924 | Colbow, Jr. | 312/242 X |
| 1,581,776 | * | 4/1926 | Altschul | 312/292 X |
| 1,980,730 | * | 11/1934 | Matchette | 312/248 X |
| 2,089,999 | * | 8/1937 | Greene | 312/245 |
| 2,131,680 | * | 9/1938 | Zahodiakin | 312/292 X |
| 2,150,064 | * | 3/1939 | John et al. | 312/292 X |
| 3,822,925 | * | 7/1974 | Osroff | 312/242 |
| 4,195,890 | | 4/1980 | Kellogg | 312/257.1 |
| 5,118,171 | * | 6/1992 | Ortiz | 312/114 |
| 5,135,293 | | 8/1992 | St-Germain et al. | 312/199 |
| 5,163,745 | * | 11/1992 | Zagata | 312/292 X |
| 5,165,769 | | 11/1992 | Wolfe | 312/227 |
| 5,306,082 | | 4/1994 | Karlin et al. | 312/405 |
| 5,570,940 | | 11/1996 | Maro | 312/257.1 |
| 5,758,936 | * | 6/1998 | Baughan | 312/245 |
| 5,974,742 | | 11/1999 | Schreiner et al. | 52/36.1 |

OTHER PUBLICATIONS

Advertisement for Tabletop Jewelry Display; Taylor Gifts (No Date Given).

Advertisement for Hair Ornament Organizer and Jewelry Organizer; John's Fifth Avenue Luggage (No Date Given).

Advertisement for Jewelry Box; Nov. 19, 1995.

Advertisement for Jewelry Armoire; Sears; Nov. 20, 1996.

Advertisement for Jewelry Chest Armoire; K–Mart; May 10, 1992.

Advertisement for Over–the–Door Accessory Organizer; Mature Outlook; Feb. 1995.

Advertisement for Musical Jewelry Box; Linden (Mfg. #GWT004083); Citi–dollars Catalog (No Date Given).

Advertisement for Beautiful Armoire (No Date Given).

Advertisement for Cherry or Oak Jewelry Armoire; Value One (No Date Given).

Advertisement for Jewelry Box; Wooden hanging Type with Mirror (No Date Given).

Advertisement for Cosmetic Organizer, Lingerie Organizer, and Jewelry Organizer; May 2000.

Advertisement for Vanity with Bench; K–Mart; May 2000.

Advertisement for Armoires and Jewelry Boxes; Dec. 4, 1998.

(List continued on next page.)

*Primary Examiner*—James O. Hansen
(74) *Attorney, Agent, or Firm*—Mark D. Wieczorek

(57) ABSTRACT

A door closet for holding articles. The door closet includes a door having a hollow interior, a volume of the hollow interior bounded at least by a backing and at least one sidewall. At least one secondary door is mounted to the door by a hinge, the secondary door further providing a boundary of the volume and including an interior wall and an exterior wall. At least one hooking device, such as a "T"-type straight pin, may be mounted to the backing or to the interior wall.

10 Claims, 5 Drawing Sheets

OTHER PUBLICATIONS

Article on Cabinet Art; Debra Lee Baldwin; San Diego Union Tribune; Jun. 14, 1998.
Advertisement for Teak Jewelry Cabinet; Scan Furniture House; San Diego Union Tribune; Apr. 12, 1997.
Advertisement for Powell Furniture Collection (armoires); Fedco Super Stores; Oct. 15, 1997.
Advertisement for Queen Anne Jewelry Armoires; Fedco Super Stores; Dec. 17, 1997.
Advertisement for Classic Treasures Armoire with Bonus Jewelry Pouch; Wal–Mart; May 1, 1996.
Advertisement for Hanging Jewelry Organizer; The Elks Magazine; Feb. 1995.
Advertisement for Jewelry Armoire; Dec. 3, 1995.
Advertisement for 100 Pocket Storage Bag; Carol Wright Gifts; Oct. 1997.
Advertisement for Jewelry Pockets; Starcrest of California; Nov. 6, 1997.
Advertisement for Cherry Jewelry Armoire; Oct. 13, 1995.
Advertisement for Treasure Chest; The Bombay Company; San Diego Union Tribune; Dec. 10, 1995.
Advertisement for Cherry or Nostalgic Oak Jewelry Armoire; Fedco Super Stores; Dec. 1994.
Advertisement for Handsome Jewelry Armoire; Nov. 26, 1993.
Advertisement for Hanging Hosiery Organizer, Hanging Jewelry Organizer, Acrylic Belt Ring, and Acrylic Scarf Holder (No Date Given).
Advertisement for Italian Burlwood Jewel Chest; Jessops; San Diego Union Tribune; Nov. 11, 1990.
Advertisement for Full Size Musical Cabinet Jewelry Box; Nov. 14, 1990.
Advertisement for Oak Jewelry Armoire; Jerome's Furniture Warehouse; The San Diego Union; Dec. 8, 1991.
Advertisement for Traditional Queen Anne Jewelry and Lingerie Chest; Mature Wisdom; 1991; p. 38.
Advertisement for Oak Jewelry Armoire, Pocket Organizer, and Eureka Jewel Chest (No Date Given).
Article entitled "Behind the Looking Glass: Storage for Accessories"; Sunset Magazine; Feb. 1990.
Advertisement for Wood Jewelry Rack (No Date Given).
Article entitled Be Open to Composite Doors as Reasonable Alternative to Wood; The San Diego Union Tribune; Feb. 7, 1999; H–15.
Charles Bickford;Shopping for Interior Doors; Taunton's Fine Homebuilding; May 1998; No. 115; pp. 86–91.

* cited by examiner

HOLLOW-DOOR CLOSET

CROSS-REFERENCES TO RELATED APPLICATIONS

There are no related applications.

CROSS REFERENCE TO FEDERAL FUNDING

N/A

CROSS REFERENCE TO MICROFICHE APPENDIX

N/A

BACKGROUND OF THE INVENTION

A. Field of the Invention

This invention pertains to closets, and more particularly to closets which may be mounted and located in hidden locations, such as within doors and within larger closets.

B. Background

FIG. 1 shows a prior art closet 10. Certain parts of the closet 10 include sidewalls 16 and doors 12. Within the sidewalls 16 and doors 12, and also within a back, top, and floor (not shown), articles 14 may be stored. Articles 14 may include clothes, jewelry, shoes, knick-knacks, etc. One disadvantage of the closet 10 is that the same is bulky and requires significant floor space in an apartment or house. With real estate prices rising throughout the country, saving square footage is an important concern for many families. Thus, many families are choosing to live in smaller dwellings to reduce cost outlays for housing. Such families, as well as others, have a need for a smaller type of closet, and one that requires little or no square footage of space to maintain.

FIG. 2 shows a prior art door assembly. The door assembly includes a door 18 mounted to a frame 20. The frame 20 includes a top piece 22, two side pieces 24, and a bottom piece 28. A handle 26 is employed to allow the door 18 to be easily opened and closed. A set of hinges are employed to provide an axis about which the door rotates (not shown for clarity in the figure). Such doors may be used on entrances to rooms or also on entrances to closets, such as walk-in closets, among numerous other uses. Such doors do not, however, provide for any other uses.

The door 18 includes a first side 17 and a second side 19. The first side 17 and the second side 19 are typically maintained in a parallel relationship with each other via insertion of a material between the first side 17 and the second side 19. This material may be Styrofoam, corrugated cardboard, etc. The material may also be strips of a material having sufficient hardness to maintain the first side 17 and the second side 19 in a fixed and preferably parallel relationship with respect to each other. In this case, the material will usually span from and between the first side 17 and the second side 19.

SUMMARY OF THE INVENTION

The present invention addresses the needs discussed above.

In one aspect, the invention is directed towards a door closet for holding articles. The door closet includes a door having a hollow interior, a volume of the hollow interior bounded at least by a backing and at least one sidewall. At least one secondary door is mounted to the door by a hinge, the secondary door further providing a boundary of the volume and including an interior wall and an exterior wall.

Implementations of the invention may include one or more of the following. At least one hooking device may be mounted to the backing or to the interior wall. The hooking device may be a "T"-type straight pin. The door closet may further include a layer of foam mounted to the backing, where the foam is selected from the group consisting of: EPS, ethafoam, polyethylene, polystyrene, polylam, and Styrofoam. The secondary door may actually be two secondary doors. Molding may be attached to the door, and the hinge of the secondary door may be attached to the molding and to the secondary door. Molding may instead be attached to the secondary door; in this case, the hinge of the secondary door may be attached to the molding and to the door. A layer of fabric may be attached to the foam, such as velvet or satin. The secondary door may be made of the same material as a material of the door.

This invention provides several advantages. The invention is easy to manufacture and is of a relatively simple design. The invention may be conveniently retrofitted to most current door frames. The invention allows storage of small or flat articles, such as jewelry, ties, etc., to be accomplished with only a minimum of space required. Other articles which may be so stored include belts, accessories, craft supplies, handkerchiefs, etc. The articles so stored are protected from accumulation of dust, etc. The user is afforded quick access to the articles, which might otherwise have languished hidden in crowded drawers. The invention allows drawer space to be freed for other uses. The invention reduces the need for stand-alone cabinets requiring substantial floor or dresser space. The invention reduces the need for corrugated cardboard to be used as filler for hollow doors, thus having beneficial impacts on the environment.

These and other objects and advantages of the present invention will become more apparent from the background above, the description hereinafter, including the claims and drawings.

BRIEF DESCRIPTION OF THE DRAWINGS

In the drawings, which illustrate an embodiment of the present invention and are not intended to be limiting.

DESCRIPTION OF THE PREFERRED EMBODIMENTS

Although hereinbelow are described what are at present considered the preferred embodiments of the invention, it will be understood that the invention can be embodied in other specific forms without departing from the spirit or essential characteristics thereof The present embodiments are, therefore, to be considered in all aspects as illustrative and not restrictive. According to the invention is limited solely by the claims appended hereto.

Figure 3:
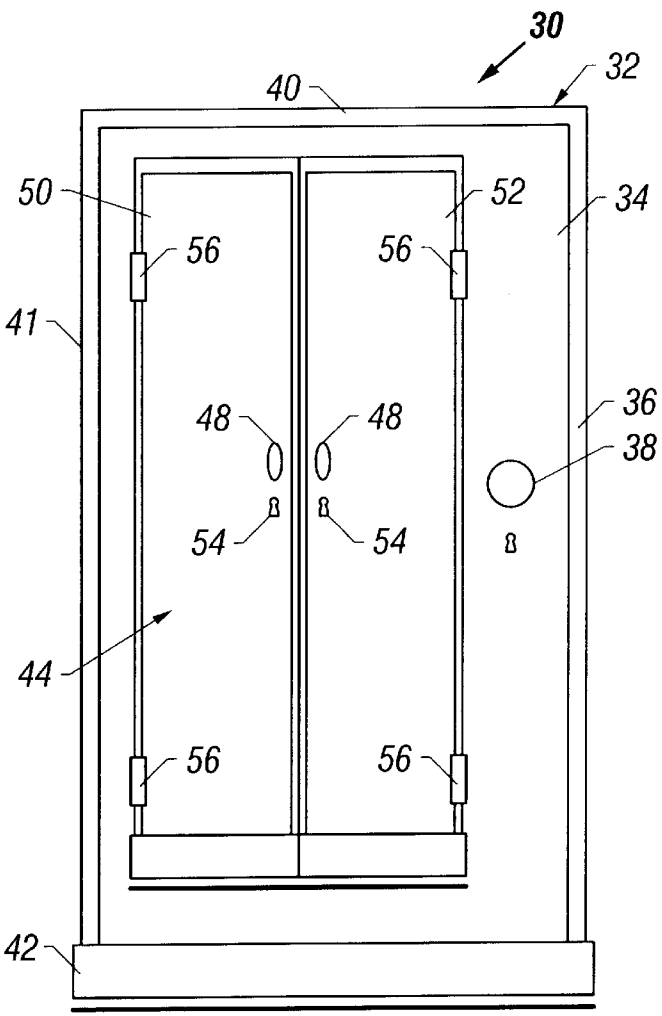
FIG. 3 is a front schematic view of an embodiment of a door closet according to the invention, showing the secondary doors in a closed position.

Turning now to the drawings, in which similar reference characters denote similar elements throughout several views, FIG. 3 illustrates one embodiment of a door closet constituting this invention.

FIG. 3 is a front schematic view of an embodiment of a door closet 44 according to the invention, shown in combination with a door assembly 30. Parts of the door assembly 30 include a door frame 32 and a door 34. The door frame 32 includes two side pieces 36 and 41, a top piece 40, and a bottom piece 42. A handle 38 is disposed on the door 34 to facilitate easy opening and closing of the same. A lock may similarly be provided. It will be noted that the door closet, disclosed in more detail below, may be kept separate from the area in which the lock is mounted (i.e., the "lock block").

Within the door 34 is a door closet 44. That is, the door closet in generally within a hollow space inside the door 34. Door closet 44 includes secondary doors 50 and 52 as well as locks 54. Of course, it will be clear to one of skill in the art that more or less than two secondary doors may be provided, and the use of locks is optional. It may be preferred to use locks when the contents of the door closet are valuable. A set of hinges 56 may be employed to allow the doors to swing freely. Handles 48 may be employed to make more convenient the opening and closing of the secondary doors.

Figure 2:
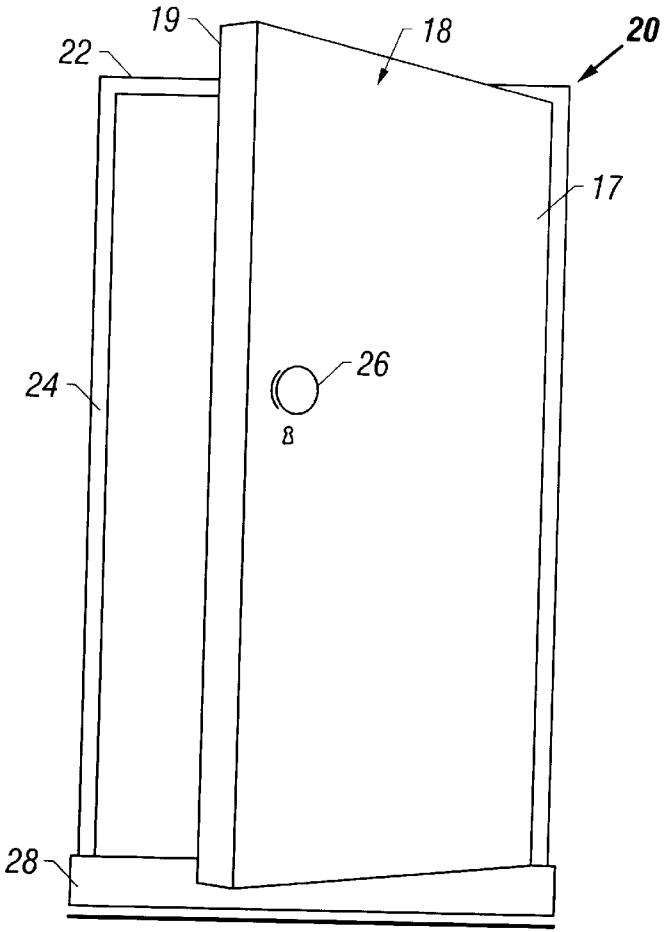
FIG. 2 (Prior Art)
FIG. 2 is a perspective view of a prior art door.
Figure 1:
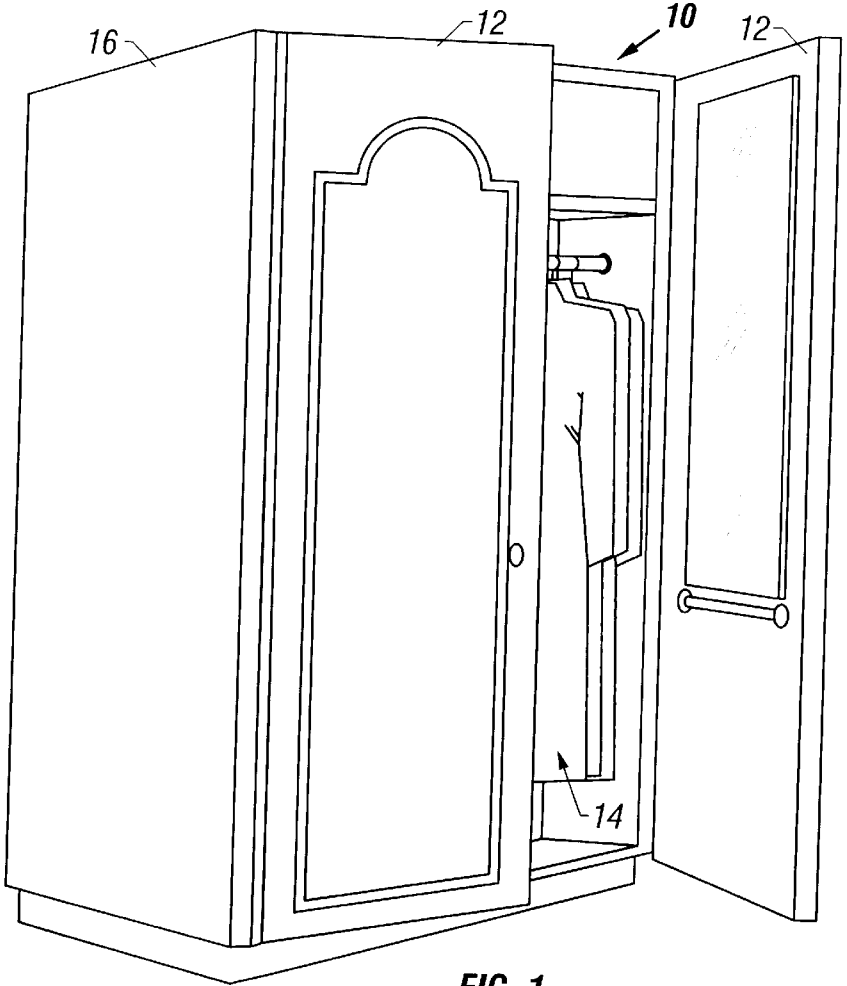
FIG. 1 (Prior Art)
FIG. 1 is a perspective view of a prior art closet.
Figure 4:
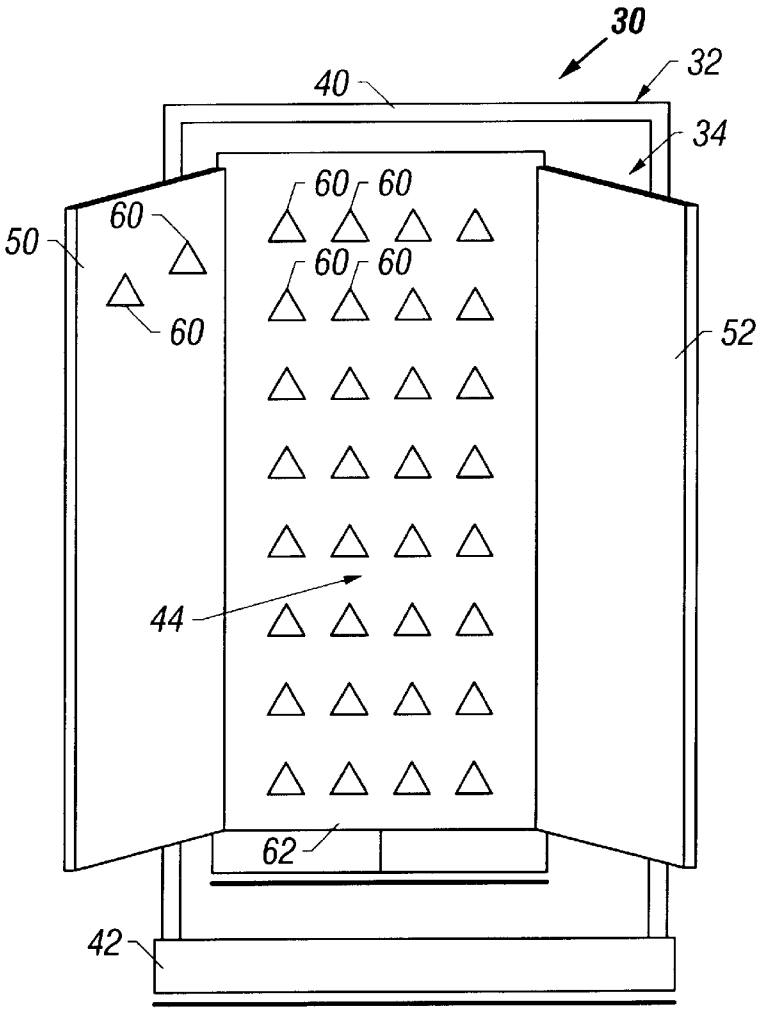
FIG. 4 is a front schematic view of an embodiment of a door closet according to the invention, showing the secondary doors in an open position.
Figure 11:
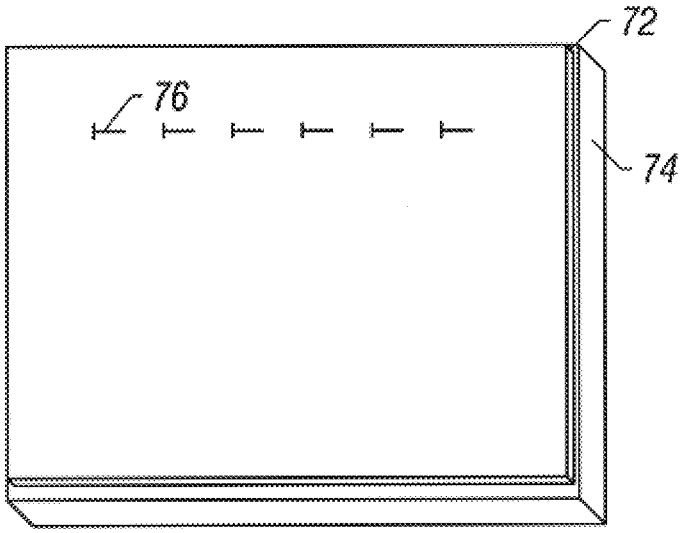
FIG. 11 is a front schematic perspective view of a portion of an embodiment according to the present invention, showing a foam layer, fabric layer, and "T" type pin.

Referring to FIG. 4, the door closet 44 is shown in an open position. In this position, the holders for various articles, identified as holders 60, are evident. The holders 60 may be hooks, clasps, "T"-type straight pins 76 (see FIG. 11), so-called "hatpins" or "headpins" such as decorative pearl headpins or any other device useful for holding articles. Hatpins may be useful as they often have colored heads and thus are easy to locate if dropped. In this regard, it is noted that thinner hatpins may be employed for certain articles, e.g., ties, as they provide easier penetration. As may be seen, the door closet 44 may be particularly useful in this regard for holding articles of jewelry, ties,other relatively flat items that may fit well within the confines of an interior of a door be seen in FIG. 4, holders 60 may be against the back wall 62 of the door closet 44 or may mounted on an interior of one of the secondary doors 50 or 52.

The holders 60 may be permanently mounted to the back wall 62, e.g., or may be temporarily mounted via use of "T"-type pins, etc. In the case where temporary hooking devices such as thumbtacks are employed, it is important to provide a backing whereby the temporary hooking devices may be inserted. While typically such a backing would be present on the back wall 62, such backing may also be present on the interior of the doors 50 or 52. This backing may be constituted of various types of Styrofoam e.g., foam 74 in FIG 11), or even just a bare piece of wood or other flat surfaced material. For example, polylam, polyethylene, ethafoam, EPS or other types of foams may be employed depending on the user's preference. EPS is already used as a filler in hollow doors. Certain foams may be preferable due to the availability of certain colors (polylam), or due to their ability to withstand many temporary hooking device insertions without loss of resiliency. Certain foams may provide an ancillary benefit of providing a certain degree of soundproofing. The characteristics of various foams are known to one of skill in the art. In any case, the thickness of the foam will be chosen such as to maintain room within the door to hold the articles to be stored. For example, if the overall door dimension is 1⅝ inches, one suitable thickness of foam may be about ½ inch. To enhance the appearance of the foam, a fabric 72 such as velvet or satin may be tacked to the same. The articles to be stored may then be tacked to the foam through the fabric. Fabric provides a benefit that the material of the fabric, when penetrated by a pin, helps to support the pin in a desired orientation.

Figure 5:
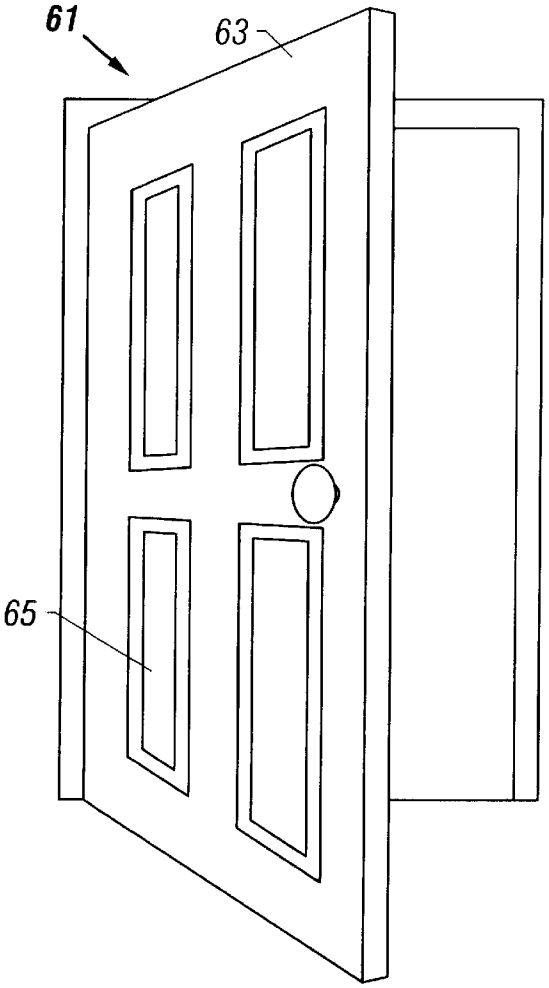
FIG. 5 (Prior Art)
FIG. 5 shows a perspective view of a prior art door employing a molding.

FIG. 5 is a perspective view of a prior art door 61. As may be seen, and as is often typical in such doors, a molding 63 may be provided to enhance the decorative quality of the door and to provide a pleasing visual effect. In particular the molding 63 is such that the same has a greater depth than sections 65 of the same door.

Figure 6:
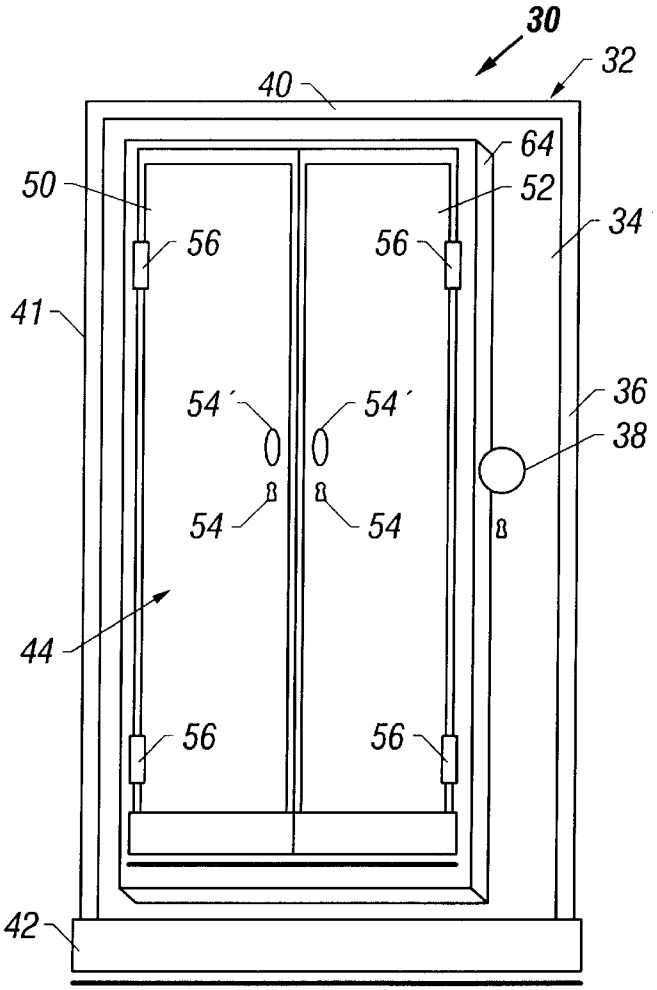
FIG. 6 is a front perspective view of an embodiment of a door closet according to the invention, showing the secondary doors mounted on a molding.

FIG. 6 is a front perspective view of an embodiment of a door closet according to the invention, showing the secondary doors mounted on a molding. Such a molding may be of the same or similar type to that shown in FIG. 5. In particular, a molding 64 is provided which may extend around the general area of the door closet 44. The hinges 56 may then be mounted to the molding 64 rather than to the door 34. In this way, the volume of the interior of the door closet 44 is greatened by an amount approximately corresponding to the depth of the molding times the area of the doors 50 and 52. The area of the doors 50 and 52 may cumulatively equate to about 10–12 square feet in most embodiments, although much smaller door closets may also be constructed. FIG. 6 shows handles 54' for opening and closing the secondary doors as well as locks 54 which may be employed to secure the door closet.

Figure 7:
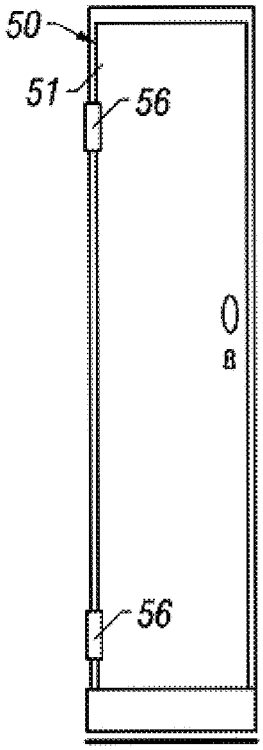
FIG. 7 shows a front schematic view of an embodiment of a secondary door for a door closet according to the invention, showing in particular an exterior wall of the secondary door.
Figure 8:
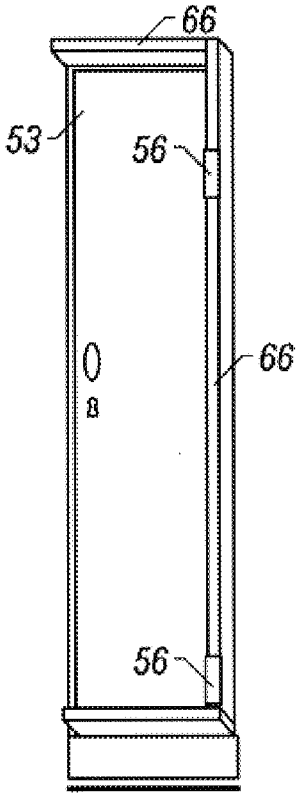
FIG. 8 shows a front schematic view of an embodiment of a secondary door for a door closet according to the invention, showing in particular an interior wall of the secondary door.

In a related embodiment, the volume of the interior of the door closet 44 may be increased by use of a molding strip 66 mounted on an interior wall (or "skin") 53 of secondary doors 50 and 52. In particular, referring to FIG. 7, a detail of the left hand side secondary door, i.e., secondary door 50, such as may be employed in the previous embodiments, is shown. The secondary door 50 may have an exterior wall 51 and an interior wall 53 (FIG. 8). However, referring to FIG. 8, the secondary door 50 of FIG. 7 may be outfitted with a molding strip 66 around the outside of the secondary door 50. The molding strip 66 may generally surround the periphery of the interior wall 53 of secondary door 50. Of course, analogous statements may be made for secondary door 52. The molding strip 66 may have dimensions, e.g., of 1" by ¼", giving an extra ¼ depth to the closet, again increasing the volume of the door closet for either additional articles to be stored, larger articles to be stored, or to provide use of a thicker, and perhaps sturdier, foam or other backing material as described above.

It is noted here that the secondary doors 50 and 52 may be simply constructed by cutting away a portion of the skin originally forming the door 34, and remounting the same with hinges attached.

Figure 9:
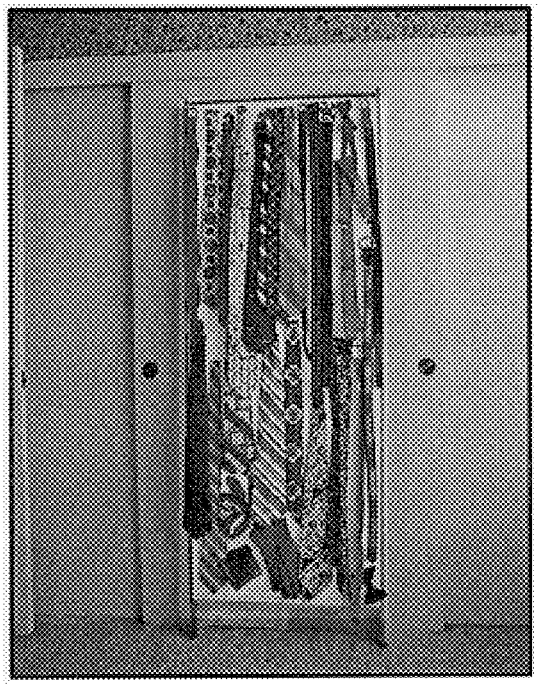
FIG. 9 is a front perspective photograph of an embodiment of a door closet according to the invention.
Figure 10:
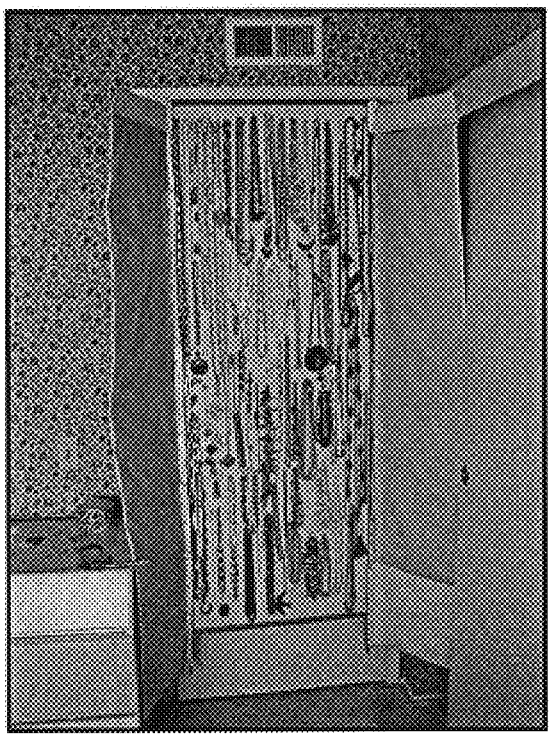
FIG. 10 is a front perspective photograph of another embodiment of a door closet according to the invention.

To further illustrate the invention, FIG. 9 shows a photograph of a door closet according to an embodiment of the present invention. It should be noted that the embodiment of FIG. 9 is a mock-up or model indicating how the embodiment may be deployed. In fact, the embodiment of FIG. 9 is not installed in the hollow of a door, but rather hanging on an existing prior art door. In any case, the FIGURE shows how an embodiment of the invention may appear. FIG. 10 shows another embodiment, this as part of a three-door closet, showing how the invention need not necessarily be installed on a typical hinged door. That is, an embodiment of the invention may be installed on numerous types of doors including sliding closet doors.

Locks for the secondary doors have been discussed above. Clasps for the doors may be provided in known manner. For example, the doors may be provided with a hook and eyelet so that they may be attached to each other. This would have the effect of keeping the doors closed when desired.

The manner of usage and operation of the invention described above being readily apparent from the above disclosure, no further discussion relative to the manner of usage and operation of the invention shall be provided.

With respect to the above description, it is to be understood that the optimum dimensional relationships for the parts of the invention, as well as variations in size, materials, shape, form, function, and manner of operation, assembly, and use, and equivalents of all the foregoing, are apparent to one skilled in the art. Such equivalents are intended to be encompassed by the invention. Therefore, the foregoing is considered as illustrative only of the principles of the invention. Further, since numerous modifications and changes will be readily apparent to those skilled in the art, it is not intended to limit the invention to the exact construction and operation shown and described, but to encompass all suitable modifications and equivalents within the scope of the invention. For example, the door closet may be mounted as the door to a walk-in closet, affording even greater storage availability. Further, in this case, or in other variations, the secondary doors may or may not be attached according to the preference of the user. The door, door closet, and secondary doors may be made of hardboard including wood, composite boards including fiberglass or carbon, or other similar materials. For fine jewelry requiring a degree of security, the doors could be made of a metal such as steel. Moreover, a portable door closet could be made similar to the door closet described above, the portable door closet being modular and capable of being slung or hung over an existing door. One or more of the doors may have a mirrored surface to allow the user the benefit of seeing their reflection. In another embodiment, rather than using doors, shades such as rolled shades may be employed. The holders may, instead of pins, etc., be made of a molded wood piece with slots cut in it to allow jewelry or other articles to be hung thereon. The scope of the invention is indicated by the appended claims rather than by the foregoing description.

What is claimed is:

1. A hollow-door closet for hanging or pinning articles, comprising:

a door including a first side sheet and a second side sheet maintained substantially in a parallel relationship with each other, such that the door is mounted to a door frame, the frame including a top piece, two side pieces, and a bottom piece, the first side sheet extending substantially between the top piece and the bottom piece when the door is in a closed position and substantially between the two side pieces when the door is in a closed position, a Dortion of the second side sheet defining an opening therethrough, a side of the first side sheet forming an exterior of the door and an opposite side of the first side sheet forming a back wall at least partially opposite the opening, the door having a hollow interior, a volume of said hollow interior bounded at least by a portion of the back wall and at least a portion of one sidewall, and further including a layer of foam mounted to a portion of the back wall; and at least one secondary door hingedly coupled to the second side sheet at a point adiacent the opening by a hinge, said secondary door further providing at least a portion of a boundary of said volume and including an interior wall and an exterior wall.

2. The door closet of claim 1, further comprising at least one hooking device mounted to said foam or to said interior wall.

3. The door closet of claim 2, wherein the at least one hooking device is a "T"-type straight pin.

4. The door closet of claim 3, wherein the foam is selected from the group consisting of: EPS, ethafoam, polyethylene, polystyrene, polylam, and Styrofoam.

5. The door closet of claim 2, further comprising a layer of fabric attached to the foam.

6. The door closet of claim 5, wherein the fabric is selected from the group consisting of:

satin and velvet and other similar materials.

7. The door closet of claim 1, wherein the at least one secondary door includes two secondary doors.

8. The door closet of claim 1, further comprising a molding attached to the door, and wherein the hinge is attached between the molding and the secondary door.

9. The door closet of claim 1, further comprising a molding attached to the secondary door, and wherein the hinge is attached between the molding and to the door.

10. The door closet of claim 1, wherein the at least one secondary door is made of the same material as a material of the door.

* * * * *